US010529243B2

(12) United States Patent
Glatfelter

(10) Patent No.: US 10,529,243 B2
(45) Date of Patent: Jan. 7, 2020

(54) BOOLEAN MATHEMATICS APPROACH TO AIR TRAFFIC MANAGEMENT

(71) Applicant: The Boeing Company, Chicago, IL (US)

(72) Inventor: John W. Glatfelter, Kennett Square, PA (US)

(73) Assignee: The Boeing Company, Chicago, IL (US)

( * ) Notice: Subject to any disclaimer, the term of this patent is extended or adjusted under 35 U.S.C. 154(b) by 37 days.

(21) Appl. No.: 15/623,656

(22) Filed: Jun. 15, 2017

(65) Prior Publication Data

US 2018/0366012 A1 Dec. 20, 2018

(51) Int. Cl.
*G08G 5/04* (2006.01)
*G08G 5/00* (2006.01)

(52) U.S. Cl.
CPC ..... *G08G 5/04* (2013.01); *G08G 5/0008* (2013.01); *G08G 5/0013* (2013.01); *G08G 5/0021* (2013.01); *G08G 5/0026* (2013.01); *G08G 5/045* (2013.01)

(58) Field of Classification Search
CPC ..... G08G 5/04; G08G 5/0021; G08G 5/0008; G08G 5/0026; G08G 5/0013; G08G 5/045
See application file for complete search history.

(56) References Cited

U.S. PATENT DOCUMENTS 4,839,658 A * 6/1989 Kathol ..... G08G 5/0013 342/29
5,867,804 A * 2/1999 Pilley ..... G01C 23/00 340/961
7,973,675 B2 7/2011 Glatfelter
2005/0200501 A1* 9/2005 Smith ..... G01S 5/06 340/963
2007/0067093 A1* 3/2007 Pepitone ..... G01C 23/005 701/120

* cited by examiner

*Primary Examiner* — Nadeem Odeh
*Assistant Examiner* — Michael V Kerrigan
(74) *Attorney, Agent, or Firm* — Coats & Bennett, PLLC

(57) ABSTRACT

Aspects of the present disclosure reduce the possibility of a collision between multiple aircraft, and provide early detection and warning capabilities to pilots and ground personnel of a potentially dangerous situation. To accomplish this function, nested 3D volumes of protected space are generated as geometric solids for each of a plurality of aircraft and monitored. Upon detecting that the volumes of protected space associated with multiple aircraft intersect each other, alarm notifications are generated to warn appropriate personnel that the aircraft could come within an unsafe distance of each other.

20 Claims, 13 Drawing Sheets

BOOLEAN MATHEMATICS APPROACH TO AIR TRAFFIC MANAGEMENT

TECHNICAL FIELD

The present disclosure relates generally to the field of air traffic control, and more particularly to computer systems for monitoring air traffic to reduce collisions.

BACKGROUND

Studies indicate that close to 7,000 aircraft are flying over the United States at any given time. To safely manage this much air traffic, aviation authorities require aircraft to be equipped with a Traffic Collision Avoidance System (TCAS). In operation, aircraft equipped with a TCAS interrogate all other aircraft that are within a predetermined range about their position. Upon receiving a response to that interrogation, the aircraft computes the distance, bearing, and altitude of the other aircraft, and uses that information to predict whether it may collide with any of the other aircraft. If the TCAS determines that the potential for collision exists, it provides visual and/or audible commands to the pilots to enable them to avoid a collision.

BRIEF SUMMARY

Aspects of the present disclosure relate to methods, apparatuses, and computer program products for monitoring aircraft traffic, and for reducing the possibility of a collision between aircraft. According to the present disclosure, these aspects may be implemented by an aircraft as part of a flight management system, or by a ground-based air traffic control system.

According to an aspect of the present disclosure, a method of managing air traffic is disclosed. The method comprises generating, for each of a plurality of aircraft, a 3-dimensional (3D) volume of protected space that surrounds and moves with the aircraft. Responsive to detecting an intersection between the volume of protected space surrounding a first aircraft and the volume of protected space surrounding a second aircraft, an alarm notification is generated.

In one aspect, generating the 3D volume of protected space comprises biasing the 3D volume of protected space in a direction of travel of the aircraft.

In another aspect, generating the 3D volume of protected space comprises generating two or more nested volumes of protected space that surround and move with the aircraft.

In another aspect, the method further comprises dynamically increasing or decreasing a volume of one or more of the nested volumes of protected space based on a phase of flight of the aircraft.

In one aspect, generating the two or more nested volumes of protected space comprises computing each nested volume of protected space based on a current velocity of the aircraft, a length of the aircraft, and corresponding horizontal, lateral, and vertical separation distance values defined for each nested volume of protected space.

In one aspect, generating the two or more nested volumes of protected space comprises generating, relative to the aircraft, an inner volume of protected space and generating an outer volume of protected space encapsulating the inner volume of protected space.

In a further aspect, generating the two or more nested volumes of protected space also comprises generating one or more intermediate nested volumes of protected space. Each of the one or more intermediate nested volumes encapsulates the inner volume of protected space, and is encapsulated by the outer volume of protected space.

In one aspect of the present disclosure, generating the alarm notification comprises generating a caution message responsive to detecting the intersection between an outer nested volume of protected space surrounding the first aircraft and any of the nested volumes of protected space surrounding the second aircraft. In another aspect, generating the alarm notification comprises generating a warning message responsive to detecting the intersection between an intermediate nested volume of protected space surrounding the first aircraft and any of the nested volumes of protected space surrounding the second aircraft. In another aspect, generating the alarm notification comprises generating a collision message responsive to detecting the intersection between an inner nested volume of protected space surrounding the first aircraft and any of the nested volumes of protected space surrounding the second aircraft.

In one aspect, detecting an intersection between the volume of protected space surrounding a first aircraft and the volume of protected space surrounding a second aircraft comprises one or more of detecting that the volume of protected space surrounding the first aircraft contacts the volume of protected space surrounding the second aircraft, detecting that the volume of protected space surrounding the first aircraft overlaps the volume of protected space surrounding the second aircraft, and detecting that the volume of protected space surrounding the first aircraft is encapsulated within the volume of protected space surrounding the second aircraft.

In one aspect of the present disclosure, the intersection between the volume of protected space surrounding a first aircraft and the volume of protected space surrounding a second aircraft is computed as a Boolean intersection.

In another aspect of the present disclosure, a computing device comprises interface circuitry and processing circuitry. The interface circuitry is configured to send and receive data. The processing circuitry, which is operatively coupled to the interface circuitry, configured to generate, for each of a plurality of aircraft, a 3-dimensional (3D) volume of protected space that surrounds and moves with the aircraft, detect an intersection between the volume of protected space surrounding a first aircraft and the volume of protected space surrounding a second aircraft, and generate an alarm notification responsive to detecting the intersection.

In one aspect, to generate the 3D volume of protected space, the processing circuitry is configured to generate two or more nested volumes of protected space that surround and move with the aircraft.

In another aspect, the processing circuitry is further configured to dynamically increase or decrease a volume of one or more of the nested volumes based on a phase of flight of the aircraft.

In one aspect, the processing circuitry is further configured to obtain, for each of the plurality of aircraft, a corresponding safety parameter file comprising horizontal, lateral, and vertical separation distance values for each nested volume of protected space, and generate the two or more nested volumes of protected space based in part on the horizontal, lateral, and vertical separation distance values.

In another aspect, to generate the two or more nested volumes of protected space, the processing circuitry is configured to generate, relative to the aircraft, an inner volume of protected space, and generate an outer volume of protected space encapsulating the inner volume of protected space.

In another aspect, to generate the two or more nested volumes of protected space, the processing circuitry is further configured to generate one or more intermediate nested volumes of protected space. In this aspect, each generated intermediate nested volume of protected space encapsulates the inner volume of protected space. Additionally, each generated intermediate nested volume of protected space is encapsulated by the outer volume of protected space.

In one aspect, the computing device comprises a collision avoidance system integrated with the first aircraft.

In another aspect, the computing device comprises a ground-based collision avoidance system.

In one aspect, the processing circuitry is configured to compute the intersection between the volume of protected space surrounding the first aircraft and the volume of protected space surrounding the second aircraft as a Boolean intersection.

In another aspect of the present disclosure, a non-transitory computer readable medium stores a computer program product for controlling a programmable computing device. In this aspect, the computer program product comprises software instructions that, when executed on processing circuitry of the programmable computing device, cause the processing circuitry to generate, for each of a plurality of aircraft, a 3-dimensional (3D) volume of protected space that surrounds and moves with the aircraft, detect an intersection between the volume of protected space surrounding a first aircraft and the volume of protected space surrounding a second aircraft, and generate an alarm notification responsive to detecting the intersection.

BRIEF DESCRIPTION OF THE DRAWINGS

Aspects of the present disclosure are illustrated by way of example and are not limited by the accompanying figures with like references indicating like elements.

DETAILED DESCRIPTION

Aspects of the present disclosure relate to a method, apparatus, and computer program product for monitoring aircraft traffic, and for reducing the possibility of collisions between aircraft on the ground and in the air. According to the present disclosure, these aspects may be implemented by an aircraft as part of its flight management system, or by a ground-based air traffic control system.

In more detail, aspects of the present disclosure generate a corresponding 3-dimensional (3D) volume of protected space for each of a plurality of aircraft. Each 3D volume is comprised of two or more nested volumes of protected space that encapsulate and move with the aircraft. A mathematical analysis is performed in order to detect whenever a nested volume of protected space surrounding one aircraft intersects a nested volume of protected space surrounding another aircraft. Responsive to detecting such an intersection, an alarm notification is generated to indicate that the two aircraft may collide and/or come within an unsafe distance of each other.

Aspects of the present disclosure provide advantages over conventional collision avoidance systems. Particularly, conventional air traffic control systems are not configured to detect that multiple aircraft may collide until one of the aircraft has entered the protected space of another aircraft. Thus, conventional systems are not able to render any warning notifications or corrective commands until after one of the aircraft has entered the protected space of another aircraft.

Aspects of the present disclosure, however, detect when the 3D volumes of protected space surrounding each aircraft intersect each other rather than waiting for the aircraft to enter the protected space of another aircraft. Because such intersections are detected before any of the aircraft enter the protected space of another aircraft, pilots and ground personnel are able to be warned of a possible collision or unsafe situation much sooner than conventional systems. Thus, aspects of the present disclosure increase the time and distance in which the pilots have to react to avoid a collision or unsafe situation.

Figure 1:
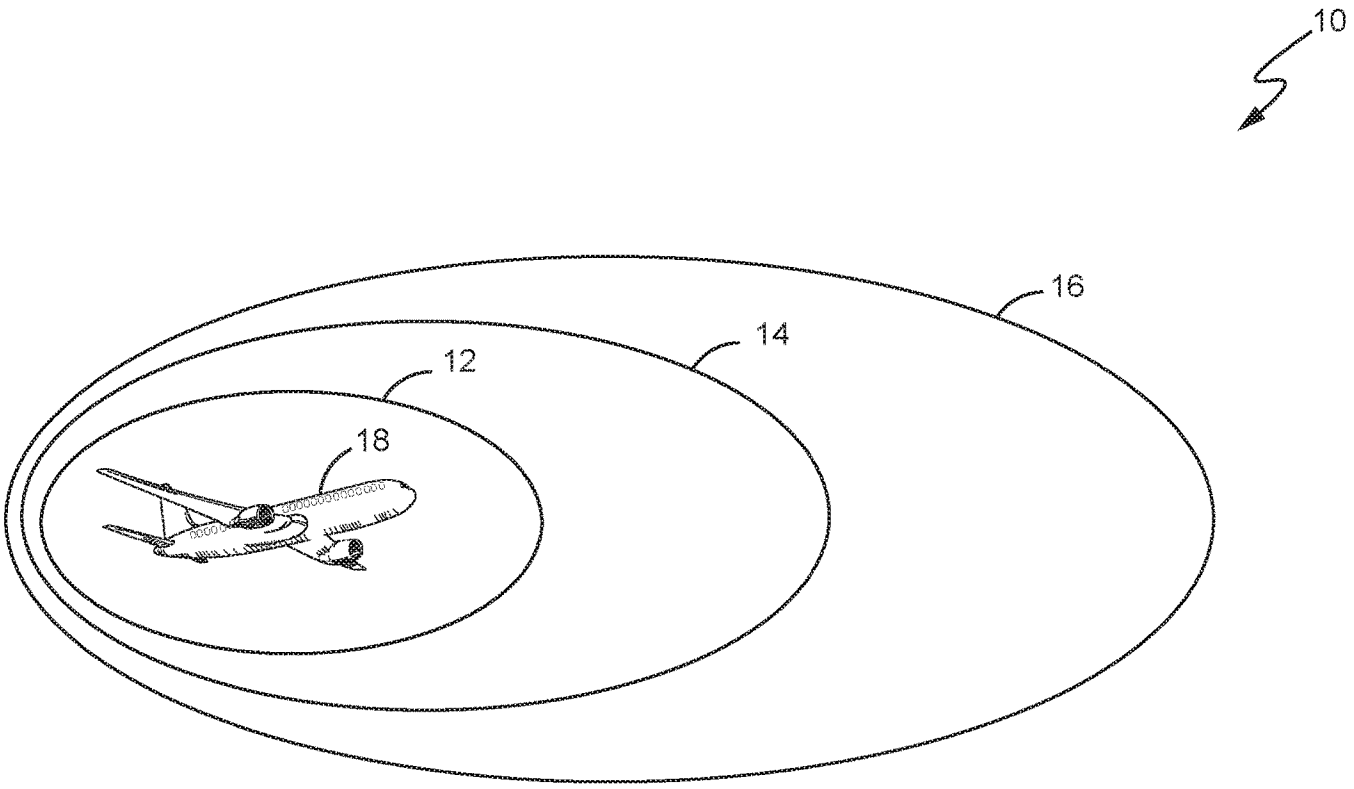
FIG. 1 illustrates a plurality of 3-dimensional nested volumes of protected space encapsulating and moving with an aircraft according to one aspect of the present disclosure.

Turning now to the drawings, FIG. 1 illustrates a 3D volume of protected space 10 that surrounds and moves with an aircraft 18 according to one aspect of the present disclosure. The 3D volume of protected space 10 comprises a plurality of nested 3D volumes of protected space—an inner 3D volume of protected space 12, one or more intermediate 3D volumes of protected space 14, and an outer 3D volume of protected space 16. As described in more detail below, each of these nested volumes of protected space 12, 14, and 16 is generated as an ellipsoid. However, those of ordinary skill in the art should appreciate that this is for illustrative purposes only. In other aspects of the present disclosure, the nested 3D volumes of protected space 12, 14, and 16 are generated as cubes, prisms, cylinders, cones, pyramids, and spheres. Regardless of the particular shape, however, each of the nested 3D volumes of protected space 12, 14, and 16 encapsulate and move with the aircraft.

In this aspect, each nested 3D volume of protected space 12, 14, 16 is generated relative to the aircraft 18 based on:

fixed parameter values, such as the length of the aircraft; and dynamically changing parameter values, such as the current velocity and altitude of the aircraft; and predefined parameter values, such as the horizontal, lateral, and vertical separation distances that are mandated by aviation authorities. These predefined parameter values typically change based on various aspects, such as the velocity and altitude of an aircraft, type of aircraft, and position of the aircraft along a flight path.

The inner 3D volume of protected space 12 is generally fixed in size and is closest to the aircraft 18. In operation, the detection of an intersection with respect to the inner 3D volume of protected space 12 indicates a serious situation. For example, detecting an intersection between the inner 3D volume of protected space 12 associated with one aircraft 18 and any of the 3D volumes of protected space 12, 14, 16 encapsulating another aircraft 18 can indicate that a collision between the two aircraft is imminent. In such cases, aspects of the present disclosure are configured to provide visual and/or audible commands to the pilots of the aircraft 18, such as "CLIMB, CLIMB!" or "DESCEND, DESCEND!" and the like, in order to avoid a collision.

In one aspect, the inner 3D volume of protected space 12 is generated according to the following equation:

$$(x^2/a_1^2)+(y^2/b_1^2)+(z^2/c_1^2)=1$$

where:

$a_1$=a transverse, equatorial radius of the inner 3D volume of protected space along the x-axis computed based on aircraft length;

$b_1$=a transverse, equatorial radius of the inner 3D volume of protected space along the y-axis computed based on aircraft length;

$c_1$=the conjugate, polar radius of the inner 3D volume of protected space along the z-axis computed based on aircraft length;

x=the x-coordinate value of the center of the aircraft—in one aspect, x is a value that represents a latitude of the aircraft during flight;

y=the y-coordinate value of the center of the aircraft—in one aspect, y is a value that represents a longitude of the aircraft during flight; and z=the z-coordinate value of the center of the aircraft—in one aspect, z is a value that represents an altitude of the aircraft during flight.

The intermediate 3D volume of protected space 14 encapsulates the inner 3D volume of protected space 12 and the aircraft 18, and is generated to provide a dynamic warning area for the aircraft 18. The detection of an intersection between the intermediate 3D volume of protected space 14 of aircraft 18 and any of the 3D volumes of protected space 12, 14, 16 encapsulating another aircraft 18 indicates that a dangerous situation exists. Responsive to detecting such an intersection, aspects of the present disclosure are configured to generate warning notifications to the pilots of aircraft 18, and in some cases to ground control personnel, to warn them of the dangerous situation. Upon receiving a warning notification, pilots would know to maintain a visual separation from the other aircraft, and to limit certain maneuvers unless necessary for the safety of the aircraft.

In this aspect, the size of the intermediate 3D volume of protected space 14 changes dynamically with the speed and altitude of the aircraft 18. Thus, the intermediate 3D volume of protected space 14 is updated throughout flight operations. This helps to optimize protection of the aircraft 18 by ensuring that the amount of protected space encapsulating the aircraft 18 is maximized when the aircraft 18 requires maximum separation distance from other aircraft 18 (e.g., such as when the aircraft 18 is at altitude and cruising speed), and minimized when the aircraft 18 does not require as much protection (e.g., when the aircraft 18 is on a taxiway or queued on a runway for takeoff).

Additionally, the intermediate 3D volume of protected space 14 is biased in the direction of flight when aircraft 18 is at cruising speed and altitude. This beneficially places the bulk of the protected space towards the front of the aircraft 18 along the flight path where protection is needed most, rather than behind the aircraft 18, where protection is needed the least. Regardless of the size, however, aspects of the present disclosure generate the intermediate 3D volume of protected space 14 such that it remains compliant with the flight regulations associated with the Military Authority Assumes Responsibility for Separation of Aircraft (MARSA) and Reduced Vertical Separation Minima (RVSM), as well as those mandated by the Federal Aviation Authority (FAA) and the National Transportation Safety Board (NTSB).

In one aspect, the intermediate 3D volume of protected space 14 is generated according to the following equation:

$$(x^2-C_{int}^2/a_2^2)+(y^2/b_2^2)+(z^2/C_2^2)=1$$

where:

$C_{int}$=A scalar reference value representing a center point of the nested intermediate 3D volume of protected space 14. The $C_{int}$ value lies along the x-axis (i.e., the length of the aircraft); however, since some aspects of the present disclosure bias the nested volumes of protected space in the direction of travel, $C_{int}$ does not necessarily coincide with the center of the aircraft. In one aspect, $C_{int}$ is computed based on current aircraft speed and a mandated horizontal separation between aircraft;

$a_2$=A transverse, equatorial radius of the intermediate 3D volume of protected space along the x-axis based on aircraft length and a mandated horizontal separation between aircraft;

$b_2$=A transverse, equatorial radius of the intermediate 3D volume of protected space along the y-axis;

$c_2$=The conjugate, polar radius of the intermediate 3D volume of protected space along the z-axis based on aircraft length and a mandated vertical separation between aircraft;

x=The x-coordinate value of the center of the aircraft—in one aspect, x is a value that represents a latitude of the aircraft during flight;

y=The y-coordinate value of the center of the aircraft—in one aspect, y is a value that represents a longitude of the aircraft during flight; and z=The z-coordinate value of the center of the aircraft—in one aspect, z is a value that represents an altitude of the aircraft during flight.

In this aspect, only one intermediate 3D volume of protected space 14 is illustrated. However, this is merely for ease of illustration. Other aspects of the present disclosure provide a plurality of nested intermediate 3D volume of protected space 14, with each nested intermediate 3D volume of protected space 14 encapsulating the inner 3D volume of protected space 12 and moving with the aircraft. In these aspects, each of the nested intermediate 3D volumes of protected space 14 are biased in the direction of flight, and dynamically re-sizable with one or more of the values for $a_2$, $b_2$, and $c_2$ varying as needed or desired.

The outer 3D volume of protected space 16 encapsulates each of the intermediate 3D volume of protected space 14, the inner 3D volume of protected space 12, and the aircraft 18, and provides pilots and ground control personnel with an anticipatory warning area for aircraft 18. The detection of an intersection between the outer 3D volume of protected space 16 of aircraft 18 and any of the 3D volumes of protected space 12, 14, 16 encapsulating another aircraft 18 functions to notify the pilots of aircraft 18 and/or the ground control personnel, of a situation about which they should be aware. Thus, responsive to detecting such an intersection, aspects of the present disclosure are configured to generate a notification to the pilots and/or the ground control personnel to apprise them of the situation. Such situations do not necessarily require the pilots to take evasive action or undergo course corrections in all cases. However, the early detection and notification afforded by the outer 3D volume of protected space 16 provides pilots and other personnel with precious additional time to locate each other's aircraft, monitor the situation, and if needed, take action to avoid any potential dangerous situations much sooner than conventional air traffic control systems.

In one aspect, the intermediate 3D volume of protected space 14 is generated according to the following equation:

$$(x^2-C_{out}^2/a_3^2)+(y^2/b_3^2)+(z^2/c_3^2)=1$$

where:

- $C_{out}$=A scalar reference value representing a center point of the nested outer 3D volume of protected space 16. The $C_{out}$ value lies along the x-axis (i.e., the length of the aircraft); however, since some aspects of the present disclosure bias the nested volumes of protected space in the direction of travel, $C_{out}$ does not necessarily coincide with the center of the aircraft. In one aspect, $C_{out}$ is computed based on current aircraft speed and a mandated horizontal separation between aircraft
- $a_3$=A transverse, equatorial radius of the intermediate 3D volume of protected space along the x-axis based on aircraft length and a mandated horizontal separation between aircraft
- $b_3$=A transverse, equatorial radius of the intermediate 3D volume of protected space along the y-axis
- $c_3$=The conjugate, polar radius of the intermediate 3D volume of protected space along the z-axis based on aircraft length and a mandated vertical separation between aircraft
- x=The x-coordinate value of the center of the aircraft—in one aspect, x is a value that represents a latitude of the aircraft during flight;
- y=The y-coordinate value of the center of the aircraft—in one aspect, y is a value that represents a longitude of the aircraft during flight; and
- z=The z-coordinate value of the center of the aircraft—in one aspect, z is a value that represents an altitude of the aircraft during flight.

In air traffic control, the term "separation" refers to the concept of maintaining a minimum distance between aircraft to reduce the risk of a collision between aircraft. Additionally, separation helps to prevents accidents due to other factors, such as wake turbulence, terrain, and other obstacles. In some aspects, separation also pertains to a controlled airspace, wherein an aircraft must stay at a minimum distance from a "block" of airspace, such as the "block" of airspace encapsulating military aircraft or the "block" of airspace that defines a "no-fly zone" over a restricted area (e.g., the White House). Generally, any aircraft that wish to enter such zones must first be approved to enter that zone.

Figure 2A:
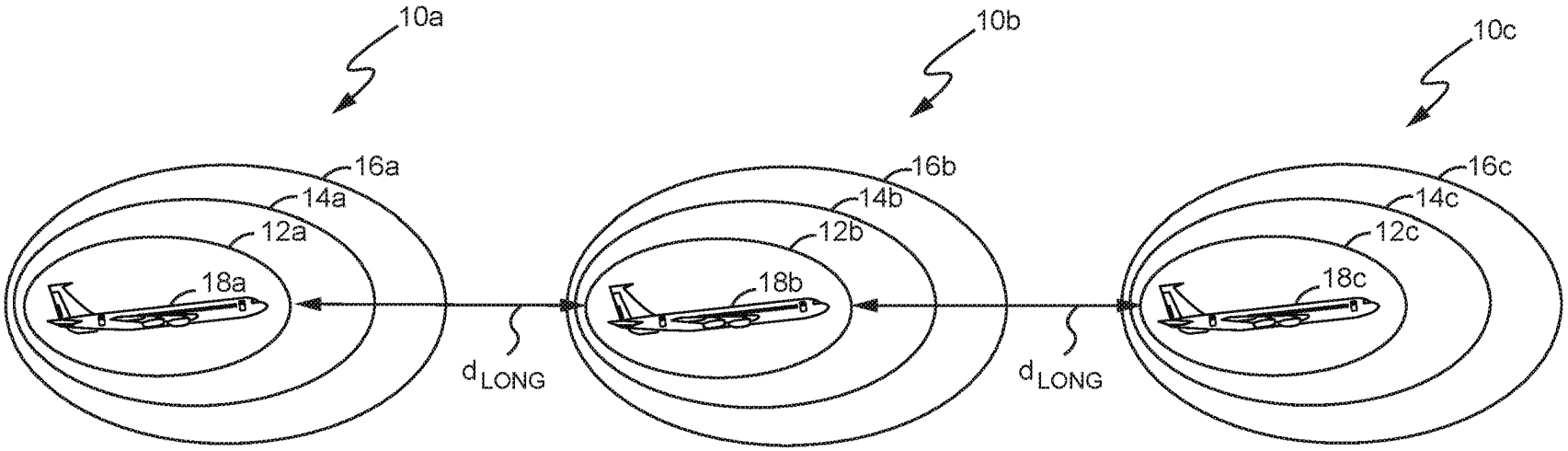
FIGS. 2A-2C illustrate, respectively, longitudinal, lateral, and vertical separation of a plurality of aircraft, with each aircraft encapsulated by a plurality of 3-dimensional nested volumes of protected space generated according to aspects of the present disclosure.
Figure 2B:
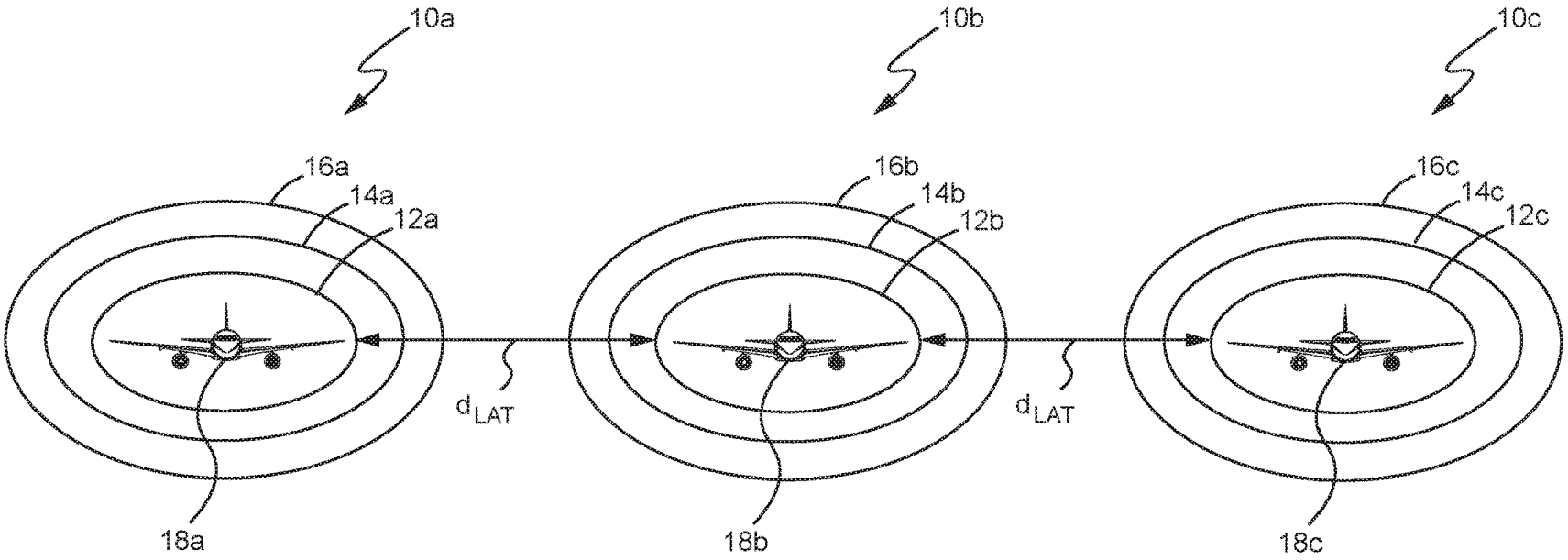
Figure 2C:
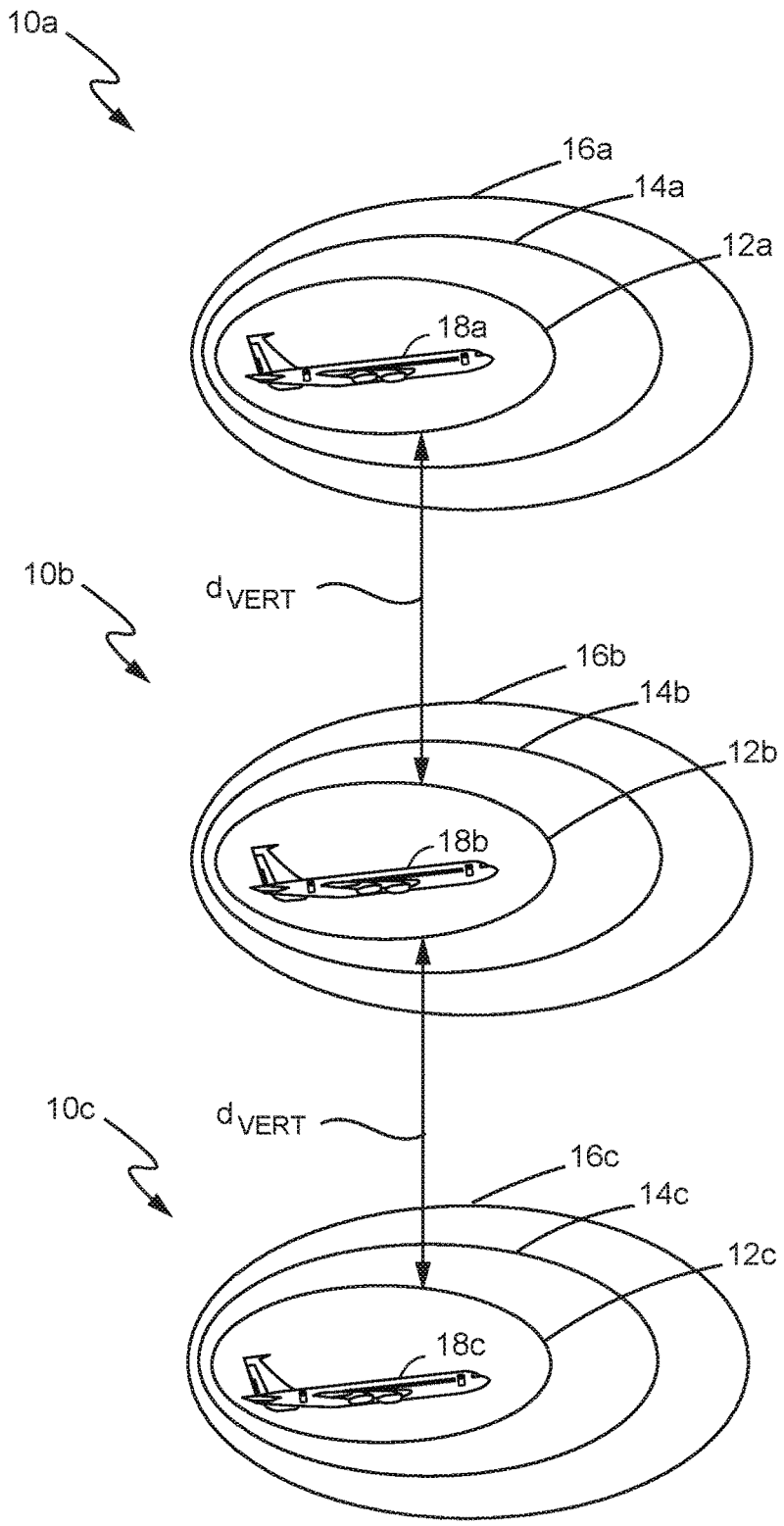

FIGS. 2A-2C illustrate different types of "separation" for which aspects of the present disclosure monitor. Particularly, FIG. 2A illustrates a longitudinal separation $d_{LONG}$ between aircraft 18*a*, 18*b*, 18*c*. As seen in FIG. 2A, the longitudinal separation $d_{LONG}$ defines the requisite longitudinal distance between the exterior surfaces of the inner 3D volume of protected space surrounding neighboring aircraft 18*a*, 18*b*, 18*c*.

Two or more aircraft are considered to be following the same flight path whenever the aircraft are not "laterally" separated (seen in FIG. 2B), and are following flightpaths that are within 45 degrees (or 135 degrees) of each other. In such situations, a minimum longitudinal separation $d_{LONG}$ between aircraft is mandated. The longitudinal separation can be based upon time and/or distance as measured by distance measuring equipment (DME); however, one rule for determining an appropriate longitudinal separation $d_{LONG}$ between two or more aircraft 18*a*, 18*b*, 18*c* is the 15-minute rule. Under this rule, no two aircraft following the same route are permitted to come within 15 minutes flying time of each other. In areas that are appropriately covered by a navigational aid system, that time is reduced to 10 minutes. If the aircraft in front is faster than the aircraft that is following it, then this time can be further reduced depending of the difference in speed between the two aircraft. Aircraft flying along routes that intersect at more than 45 degrees are said to be crossing. In these cases, longitudinal separation is not applied to separate the aircraft. This is because a lateral separation between such aircraft is more appropriate.

FIG. 2B illustrates a lateral separation $d_{LAT}$ between aircraft 18*a*, 18*b*, 18*c* in accordance with one aspect of the present disclosure. The lateral separation $d_{LAT}$ defines the requisite lateral distance between the exterior surfaces of the inner 3D volumes of protected space surrounding neighboring aircraft 18*a*, 18*b*, 18*c*.

Lateral separation is applied whenever two or more aircraft 18*a*, 18*b*, 18*c* are vertically separated by a distance that is less than the mandated minimum vertical separation distance. The minimum distance for such lateral separation between aircraft is usually determined based upon a current position of the aircraft. The position can be derived visually (e.g., dead reckoning) or determined from internal navigation sources, or determined from radio navigation aids, such as beacons. When beacons are used, the aircraft should be a predetermined distance from the beacon, as measured by time or by DME, and their paths to or from the beacon must diverge by some minimum predetermined angle. Other techniques for determining a lateral separation $d_{LAT}$ between aircraft may be defined by the geography of a pre-determined route or flight path such as the flight paths of the North Atlantic Organized Track System (NAT-OTS).

FIG. 2C illustrates a vertical separation $d_{VERT}$ between aircraft 18*a*, 18*b*, 18*c* in accordance with one aspect of the present disclosure. As shown in FIG. 2C, the vertical separation $d_{VERT}$ defines the requisite vertical distance between the exterior surfaces of the inner 3D volumes of protected space surrounding neighboring aircraft 18*a*, 18*b*, 18*c*.

Vertical separation distances are typically mandated by the various aviation authorities (e.g., FAA) and depend on various factors such as the type of aircraft and altitude. In general, current regulations mandate that no aircraft should come vertically closer than 1000 feet (300 meters) to another aircraft when they are between the earth's surface and an altitude of 29,000 feet (8,800 meters). However, this vertical separation distance can be reduced provided that the aircraft are laterally separated by a distance of $d_{LAT}$. For aircraft flying above 29,000 feet (8,800 meters), regulations mandate that the vertical separation between aircraft be no less than 2,000 feet (600 meters).

There are some exceptions to the rules, however. One exception applies to aircraft flying at an altitude between 29,000 and 41,000 feet (8,800-12,500 meters) that are equipped with modern altimeter and autopilot systems. In this case, the mandated minimum vertical distance separating two aircraft can be reduced to 1,000 feet (300 meters).

Another exception applies to aircraft occupying airspace where RVSM can be applied. RVSM airspace encompasses Europe, North America, parts of Asia and Africa, and both the Pacific and Atlantic oceans. In areas where RVSM capabilities exist, aircraft must be vertically separated by 1,000 feet (300 meters) in altitudes up to FL410 (41,000 feet). Aircraft flying between altitudes of 41,000 feet and 60,000 feet must be vertically separated by a distance of 2,000 feet (600 meters).

Regardless of these exceptions, however, current regulations mandate that all aircraft flying at an altitude above 60,000 feet be vertically separated by a distance of 5,000 ft.

In some situations, the military has authority to override the current regulations and assume responsibility for aircraft separation. Under such conditions, which are referred to as MARSA, multiple military aircraft are encapsulated within a single "block" of protected airspace. All military aircraft within this block of protected airspace are then treated as a single aircraft and assigned a single data tag on an air traffic controller's scope. Thus, under MARSA conditions, the longitudinal, lateral, and vertical separation distances are relative to the block rather than between aircraft.

As previously stated, each of the nested 3D volumes of protected space 12, 14, 16 are generated based on various dynamically changing factors, such as the current speed and altitude of the aircraft 18, and the current location of the aircraft 18. Because these factors typically change multiple times during flight operations, aspects of the present disclosure are configured to dynamically re-size one or more of the nested 3D volumes of protected space 12, 14, 16 accordingly. The ability of the present disclosure to dynamically alter the size of one or more of the nested volumes of protected space 12, 14, 16 according to aspects of the present disclosure is seen in FIG. 3.

Figure 3:
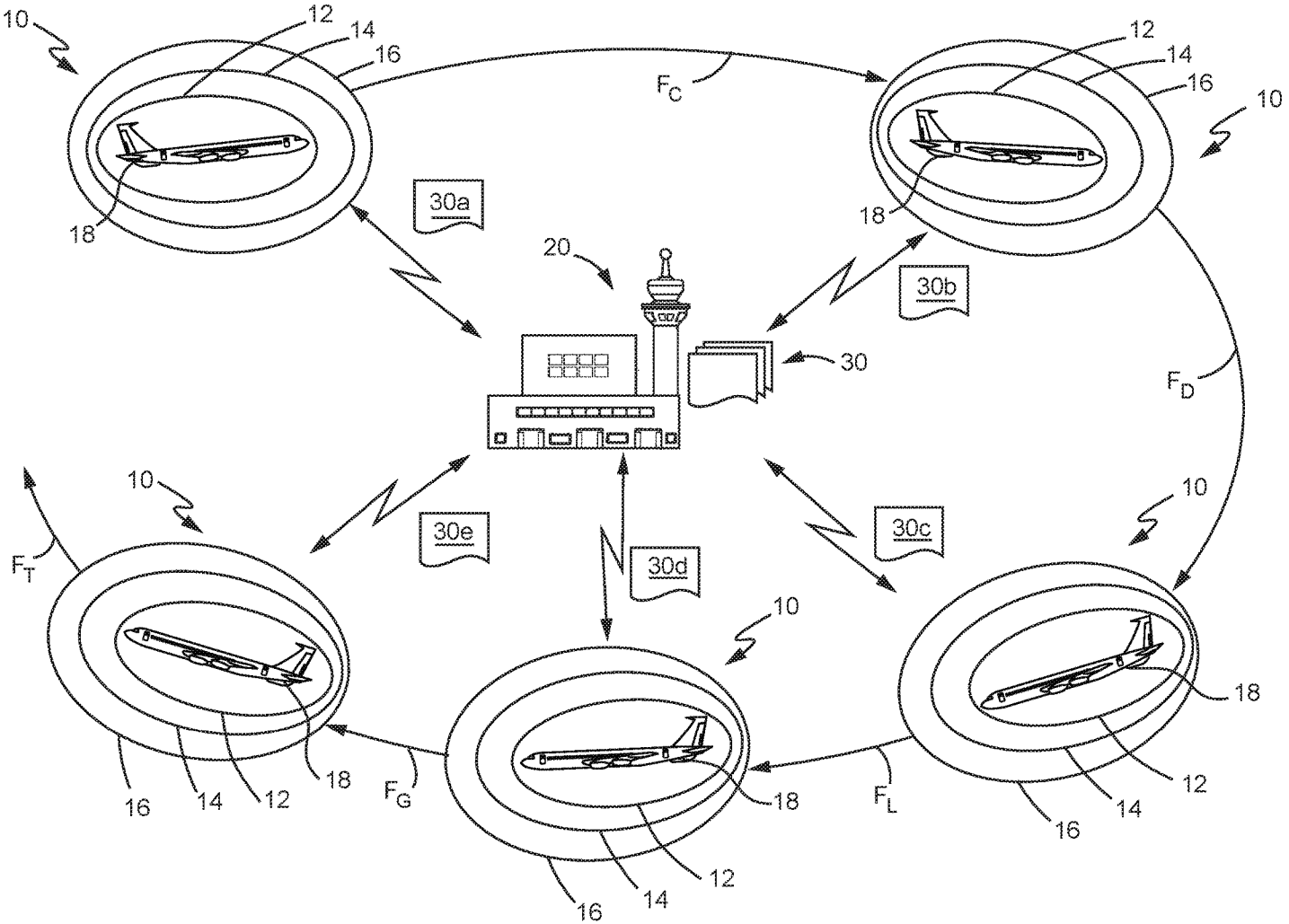
FIG. 3 illustrates air traffic management based on a phase of flight of an aircraft according to one aspect of the present disclosure.

In more detail, FIG. 3 illustrates air traffic management based on a phase of flight of an aircraft according to one aspect of the present disclosure. As seen in FIG. 3, a control tower 20 communicates with aircraft 18 along its flight path F, which in this aspect, comprises five different segments or phases. A first segment $F_C$ indicates the flight path of aircraft 18 at cruising altitude. A second segment $F_D$ represents the flight path of aircraft 18 during its descent into an airport. A third segment $F_L$ represents the flight path of aircraft 18 during landing, and a fourth segment $F_G$ represents the flight path of aircraft 18 while it taxis on the ground. The fifth segment $F_T$ represents the flight path of aircraft 18 as it takes off from the airport. There could be other phases not specifically illustrated here; however, in this aspect of the present disclosure, aircraft 18 is in communication with the control tower 20 regardless of the particular phase of its flight path F.

To facilitate dynamically re-sizing the nested 3D volumes of protected space 12, 14, 16, one aspect of the present disclosure maintains a plurality of safety parameter files 30*a*, 30*b*, 30*c*, 30*d*, and 30*e* for each different type of aircraft 18. Each safety parameter file 30*a*, 30*b*, 30*c*, 30*d*, and 30*e* (collectively, 30) stores the various parameter values that are utilized to generate the nested 3D volumes of protected space 12, 14, 16 for aircraft 18 along a corresponding flight path segment $F_C$, $F_D$, $F_L$, $F_G$, and $F_T$. Such files 30 are stored in a database, for example, that is accessible to the flight control systems at the control tower 20. Table 1 illustrates the parameter values that are stored in an exemplary safety parameter file 30 in accordance with one aspect of the present disclosure.

TABLE 1

| | |
|---|---|
| TYPE | BOEING 767-300 |
| LOCATION | 41°24'12.2"N 2°10'26.5"E |
| ALTITUDE (A) | 33,000 feet |
| VELOCITY (V) | 520 mph |
| //Inner Vol. | |
| $a_1$ | 0.5K |
| $b_1$ | 0.5K |
| $c_1$ | 0.5K |
| R | 1.0 |
| //Intern. Vol. | |
| $C_{INT}$ | (V/500) * L/5 |
| $a_2$ | 0.5K + Horizontal Separation |
| $b_2$ | 0.5K + Lateral Separation |
| $c_2$ | 0.5K + Vertical Separation |
| R | 1.0L |
| //Outer Vol. | |
| $C_{OUT}$ | (V/500) * L/4 |
| $a_3$ | 0.5K + (2 * Horizontal Separation.) |
| $b_3$ | 0.5K + (2 * Lateral Separation.) |
| $c_3$ | 0.5K + (2 * Vertical Separation) |
| R | 1.0M |

where:
K = Aircraft length;
L = 2 * Lateral Separation distance;
M = 2 * Vertical Separation distance; and
R = Raidus.

As aircraft 18 moves along the different segments of flight path F, control tower 20 transmits the appropriate safety parameter file 30*a*, 30*b*, 30*c*, 30*d*, or 30*e* to aircraft 18 over a transponder frequency. Upon receiving the safety parameter file 30*a*, 30*b*, 30*c*, 30*d*, and 30*e*, a flight computer on aircraft 18 computes each of the nested 3D volumes of protected space 12, 14, 16 that encapsulate and move with the aircraft 18. The results of the computations are then output to a display on aircraft 18 enabling the pilots to visually observe the aircraft 18 surrounded by the nested 3D volumes of protected space 12, 14, 16.

Additionally, other aircraft perform similar functions in accordance with the aspects of the present disclosure, and transmit their computational results to the flight computer of aircraft 18. Upon receipt, the flight computer outputs the results to the display on aircraft 18 enabling the pilots to visually observe other nearby aircraft surrounded by their respective nested 3D volumes of protected space 12, 14, 16. As described in more detail later, each aircraft 18 is then capable of detecting possible collisions and other dangerous or warning situations with respect to the nearby aircraft by detecting whether any of its nested 3D volumes of protected space intersect any of the nested 3D volumes of protected space of the nearby aircraft.

It should be noted that Table 1 identifies parameter values that are both fixed and variable. Further, some of the parameter values, such as the aircraft velocity, altitude, and location or position, are computed using the various flight systems and sensors on aircraft 18. However, some or all of the parameter values are computed in conjunction with other systems.

Aspects of the present disclosure are configured to determine and track the positions of various aircraft using various methodologies. One such method utilizes primary radar. With this method, radar stations—whether they are ground-based or aircraft-based—emit electromagnetic waves. The waves may be pulsed or continuous, and reflect off of most, if not all, objects in their path. The reflected waves return to the radar station and are used by the receiving radar station to compute the object's velocity and position.

Another method for tracking the position of the aircraft involves secondary surveillance systems. With these systems, radar stations (i.e., ground-based and/or aircraft-based) or other stations transmit signals specifically to a plane's transponder, which is a radio transmitter in the cockpit of an aircraft. Responsive to receiving these signals, systems on board the aircraft obtain information on the plane's location or position, altitude, direction of movement, and velocity, and provide that information to the transponder for transmission back to the station.

Currently, the processes implemented by such secondary surveillance systems are moving toward a GPS-based implementation. Such GPS aircraft tracking solutions are possible when an aircraft is equipped with a GPS receiver. By communication with GPS satellites, detailed real-time data on flight variables such as location or position, velocity, altitude, and direction of travel, can be provided to a computer server on the ground. This server stores the flight data, which is then transmitted to various organizations via various telecommunications networks. The organizations then interpret the data, and in some aspects of the present disclosure, compute the parameter values that are used in generating the nested volumes of protected space 12, 14, 16. Such telecommunications networks and methodolgies include, but are not limited to:

- The Aircraft Communications Addressing and Reporting System (ACARS)—a system comprising a hybrid of the Very High Frequency (VHF), satellite, and High Frequency (HF) networks configured for transmitting short messages between aircraft and ground stations;
- Automatic Dependent Surveillance-Broadcast (ADS-B)—a system in which aircraft determine their positions via GPS, and periodically broadcast that information using their "Mode S" transponder;
- Various satellite networks such as Globalstar, Inmarsat, IRIDIUM, and Thuraya; and
- The Global System for Mobile Communications (GSM) network.

Thus, in some aspects of the present disclosure, the parameters are transmitted to the ground and other aircraft using GPS and/or by leveraging one or more of these networks and systems. This allows for the real-time, anticipatory separation calculations to be performed in the cockpit of the aircraft and/or by the computer systems associated with the control tower 20 or other ground-based entity.

Other aspects of the present disclosure can employ networks and/or methodologies not specifically listed here. In general, however, the methods and networks described above for obtaining flight data, communicating that data, and for computing the corresponding parameter values used in generating the nested volumes of protected space 12, 14, 16 require little or no cooperation from the pilots and are performed automatically.

In some aspects, therefore, aircraft 18 will monitor and maintain the parameter values in the safety parameter file 30 that it is able to measure, while updating the other parameter values (a, b, c, etc.) using the data and information received from the control tower 20. Thus, the control tower 20 is configured according to the present disclosure to transmit the entire safety parameter file 30 to aircraft 18, or just the parameter values that are needed by aircraft 18.

FIG. 3 illustrates an "aircraft-based" aspect of the disclosure in which each aircraft 18 is configured to generate its nested 3D volumes of protected space 12, 14, 16, and detect any intersections with its nested 3D volumes of protected space 12, 14, 16, on the aircraft 18. However, those of ordinary skill in the art should realize that the present disclosure is not so limited. In a "ground-based" aspect of the present disclosure, a flight computer associated with the control tower 20 receives some or all of the parameter values stored in the different safety parameter files from the different aircraft 18 over a transponder frequency, and then generates corresponding nested 3D volumes of protected space 12, 14, 16 for each of those aircraft 18 using those received parameter values. In these aspects, the control tower 20 is configured to output the results of the computations to a display monitor so that ground control personnel are able to visually discern each aircraft 18 and its corresponding nested 3D volume of protected space 12, 14, 16. Additionally, the control tower 20 is also configured to transmit the results of the computations to the aircraft 18 over an appropriate transponder frequency. Upon receipt, a flight computer aboard aircraft 18 can process and output the results to a display on the aircraft 18.

Regardless of where the display is located, however, the ability to visually discern the various aircraft 18 and their corresponding nested 3D volumes of protected space 12, 14, 16 provides multiple benefits. Particularly, aspects of the present disclosure enable both ground-based detection and aircraft-based detection of such possibly dangerous situations. Further, it enhances the ability of both the ground control personnel and the pilots to quickly and easily identify potential dangerous situations between different aircraft 18 much sooner than if they were to rely on conventional tracking systems. Thus, aspects of the present disclosure increase the lead time personnel have to apply any needed corrective measures to avoid a potential catastrophe. Moreover, it ensures that these personnel are better able to maintain the appropriate separation distances between the various aircraft 18. This latter benefit is especially helpful given the large number of aircraft that are in flight or on the ground at any given time.

To facilitate the early detection of a potential collision or dangerous situation between two aircraft 18, aspects of the present disclosure analyze each nested 3D volume of protected space 12, 14, 16 surrounding each different aircraft 18 as if each nested 3D volume was a geometric solid, such as a Boolean solid. This enables aspects of the present disclosure to employ Constructive Solid Geometry (CSG) modeling techniques to determine when two such nested 3D volumes intersect each other. Such techniques are easy to implement, as well as computationally fast and efficient, and include, but are not limited to, Boolean intersection analyses. As previously described, the computations executed to detect the intersections between two or more such "solid" nested 3D volumes of protected space can be done by a computer that is on the aircraft 18, associated with the control tower 20, or both.

Figure 4A:
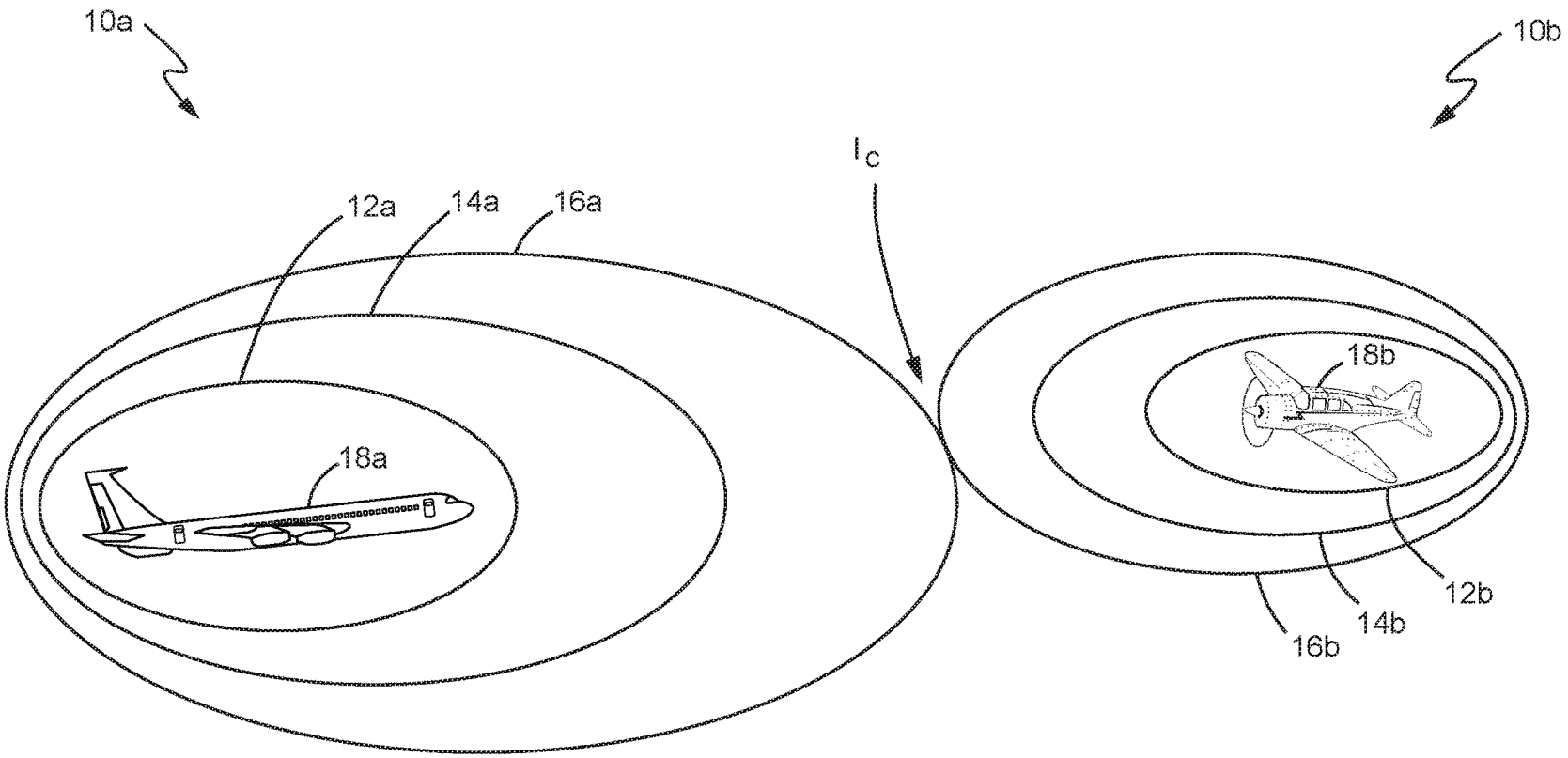
FIGS. 4A-4C illustrate some exemplary intersections of the 3-dimensional nested volumes of protected space associated with corresponding aircraft according to one aspect of the present disclosure.
Figure 4B:
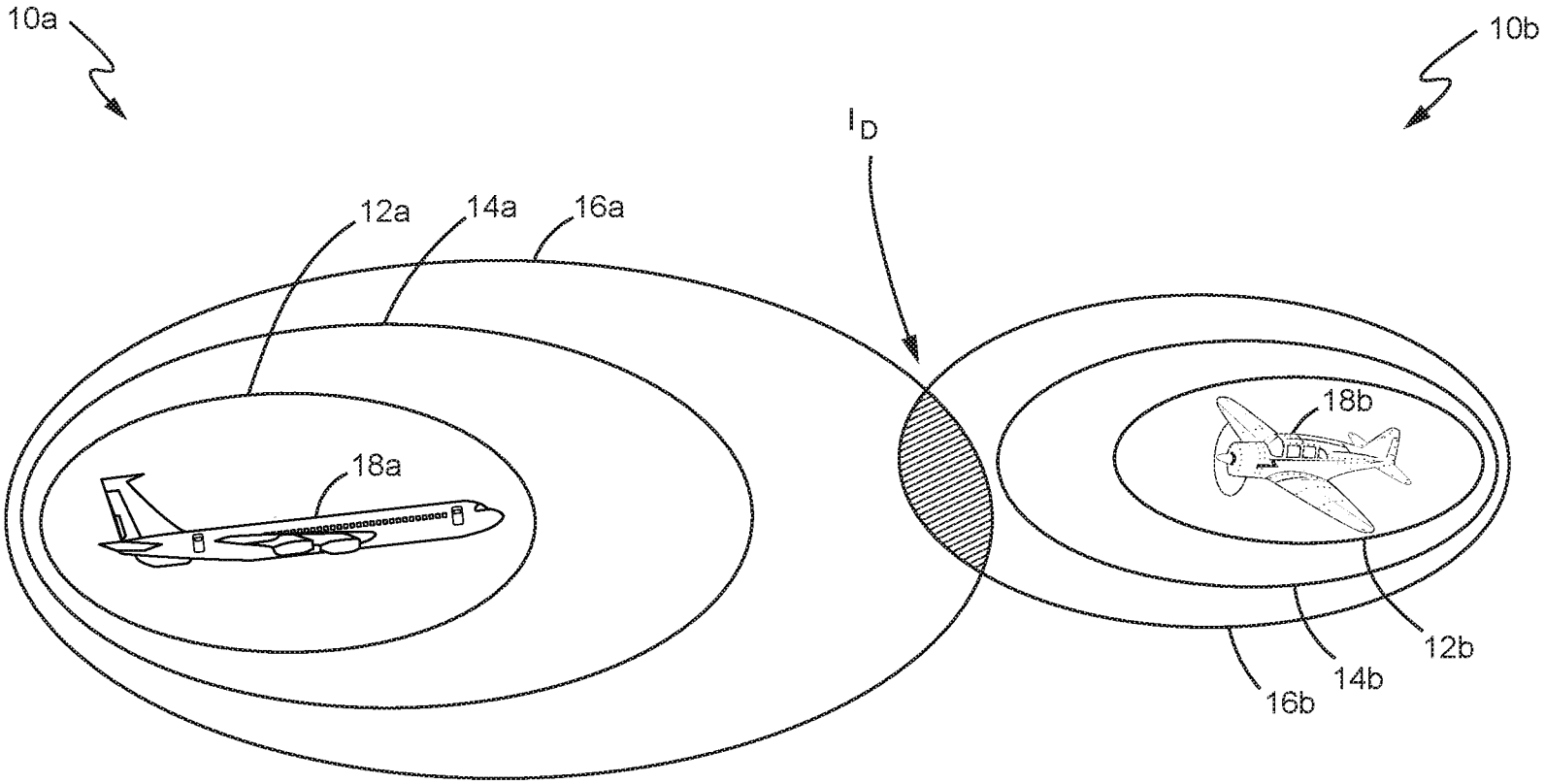
Figure 4C:
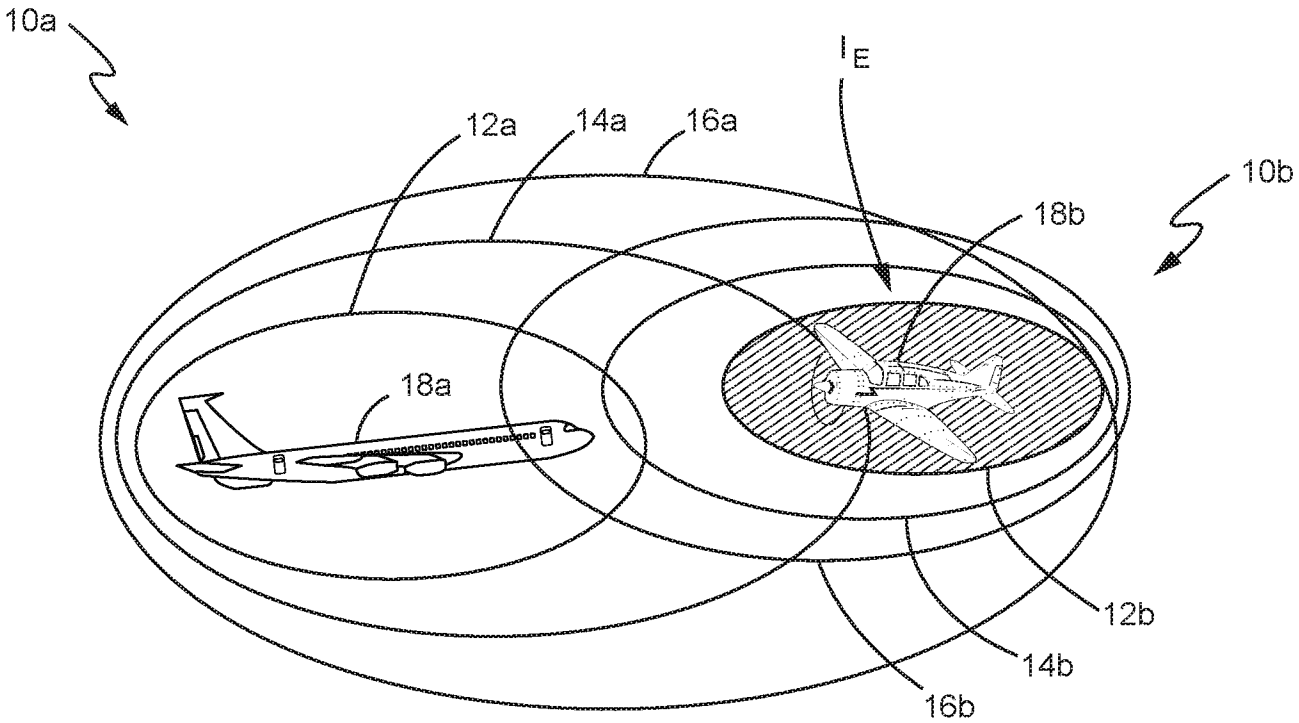

FIGS. 4A-4C illustrate some exemplary types of intersections able to be detected according to aspects of the present disclosure. In each of these figures, each of two aircraft 18*a*, 18*b* are encapsulated by respective nested 3D volumes of protected space 12*a*, 12*b*, 14*a*, 14*b*, 16*a*, 16*b*.

FIG. 4A illustrates a first type of intersection $I_C$ that is detected when the outer 3D volume of protected space 12*a* associated with aircraft 18*a* "contacts" the outer 3D volume of protected space 12*b* associated with aircraft 18*b*. Detecting intersection $I_C$ provides both the pilots and the ground personnel with the earliest possible notification of the proximity of other aircraft.

FIG. 4B illustrates a second type of intersection $I_O$ that is detected when the outer 3D volume of protected space 12*a* associated with the aircraft 18*a* overlaps at least part of a 3D volume of protected space 12*b*, 14*b*, 16*b* associated with aircraft 18*b*. This type of intersection indicates that aircraft 18*a*, 18*b* are closer to each other, and thus, notifications generated for the pilots and the ground personnel responsive to detecting intersection $I_O$ are higher in priority than those generated responsive to detecting a "contact" type of intersection $I_C$.

FIG. 4C illustrates a third type of intersection $I_E$ that is detected when the analysis indicates that aircraft 18*b* is partially or wholly enveloped by one or more of the nested 3D volumes of protected space 12*a*, 14*a*, 16*a*. This type of intersection indicates that aircraft 18*a*, 18*b* are dangerously closer to each other, and may collide or come perilously close to each other. Thus, notifications generated for the pilots and the ground personnel responsive to detecting such intersections $I_E$ have the highest priority. Particularly, in some aspects, audible warnings are generated in addition to visual warnings, and further, include commands for the pilots to execute to avoid a collision.

Regardless of the type of intersection $I_C$, $I_O$, $I_E$ that is detected, however, aspects of the present disclosure are configured to generate and send different warning messages to appropriate personnel. Because aspects of the present disclosure generate and analyze the protected space around an aircraft as multiple nested 3D volumes of protected space, and since the CSG analysis used to detect these intersections is fast and efficient, aspects of the present disclosure are able to alert the pilots and ground crew personnel of a potentially dangerous much sooner than conventional tracking systems are able to provide such warnings. As a result, aspects of the present disclosure increase the time that pilots have to avoid and/or react to dangerous situations, thereby making flight operations safer.

Figure 5:
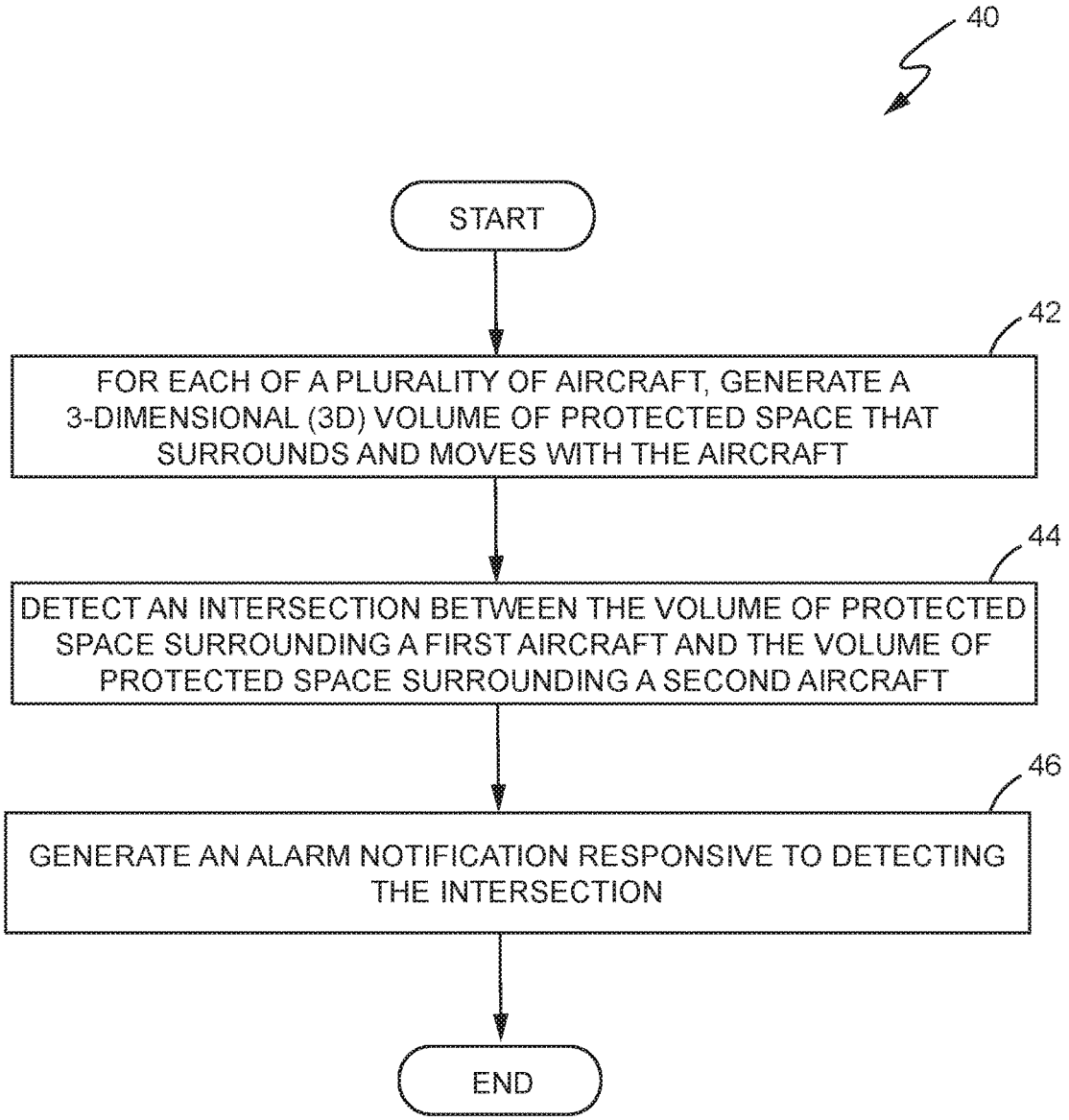
FIG. 5 is a flow diagram illustrating a method of managing air traffic according to one aspect of the present disclosure.

FIG. 5 is a flow diagram illustrating a method 40 of performing an aspect of the present disclosure. As previously stated, method 40 is implemented by a computer on an aircraft 18, associated with the ground control tower 20, or both.

In accordance with the aspect illustrated in FIG. 5, method 40 begins with generating, for each of a plurality of aircraft 18, a 3D volume of protected space 10 that surrounds and moves with the aircraft 18 (box 42). Once the 3D volumes of protected space are generated, each aircraft 18 is monitored to detect whether its corresponding 3D volume of protected space 10 intersects with any of the 3D volume of protected space 10 associated with another aircraft 18. Responsive to detecting an intersection $I_C$, $I_O$, or $I_E$ between the 3D volume of protected space 10 encapsulating a first aircraft 18, and the 3D volume of protected space 10 encapsulating a second, different aircraft 18 (box 44), method 40 generates an alarm notification to alert the appropriate personnel (box 46).

As previously stated, the generation of the 3D volumes of protected space 10, as well as the analysis performed to detect an intersection $I_C$, $I_O$, or $I_E$ between the 3D volumes of protected space 10 of different aircraft 18, facilitates providing appropriate personnel with advanced warning of potentially dangerous situations between two or more aircraft 18 in a fast and efficient manner.

Figure 6A:
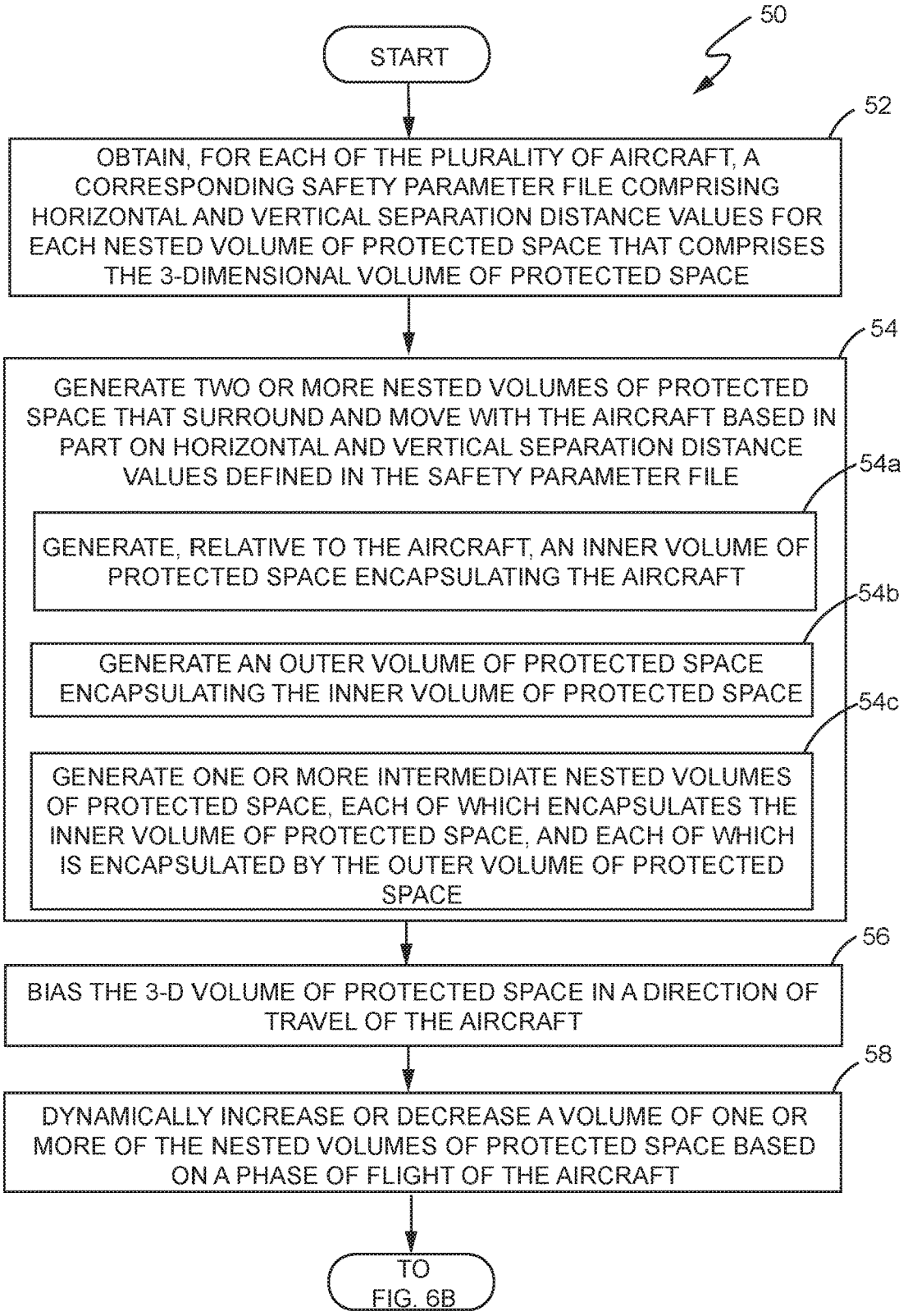
FIG. 6A is a flow diagram illustrating a method of generating and managing 3-dimensional nested volumes of protected space that surround and move with an aircraft according to one aspect of the present disclosure.
Figure 6B:
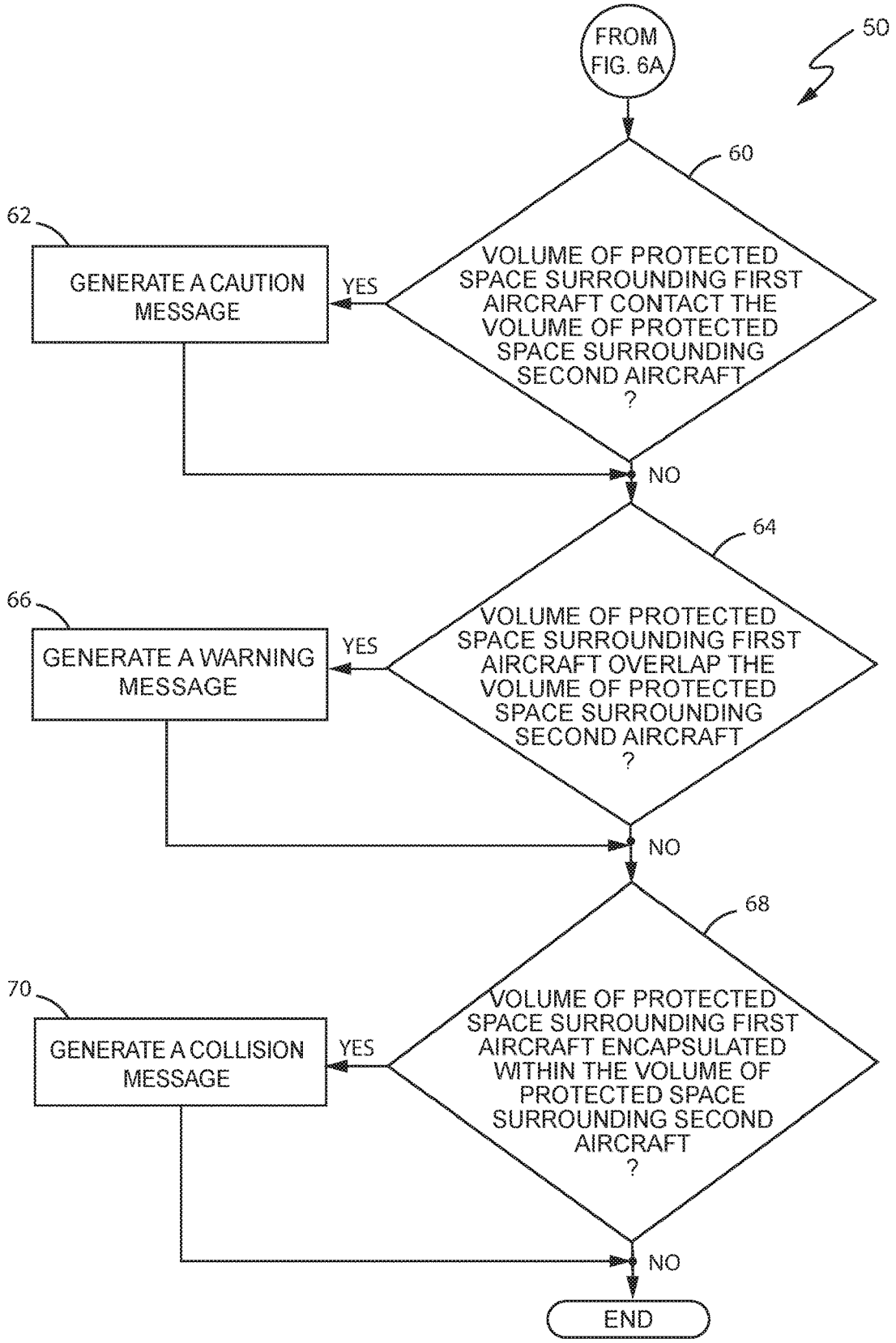
FIG. 6B is a flow diagram illustrating a method of detecting an intersection between the 3-dimensional nested volumes of protected space associated with an aircraft, and generating an alarm notification based on that detection according to one aspect of the present disclosure.

FIGS. 6A-6B are flow diagrams illustrating a method 50 for implementing an aspect of the present disclosure in more detail. As seen in FIG. 6A, method 50 begins with obtaining, for each of the plurality of aircraft 18, a safety parameter file 30 that corresponds to that aircraft 18. Each safety parameter file is specific to an aircraft 18, and comprises various data utilized in the generation of the 3D volume of protected space 10 and any subsequent intersections $I_C$, $I_C$, or $I_E$ that occur between them. Such data includes the horizontal, lateral, and vertical separation distance values used in generating the 3D volume of protected space 10 for the aircraft 18 (box 52).

Maintaining these parameter values in a safety parameter file 30 allows aspects of the present disclosure to dynamically update these values, and others, as needed during flight operations. This is beneficial because these values can, and do change, during flight. Additionally, such values are very easy to communicate to and from the aircraft 18 over a transponder frequency with very little to no additional overhead or delay. Thus, the 3D volumes of protected space 10 for a given aircraft 18 are very easily maintained at an appropriate size for the aircraft's 18 speed and altitude.

Once method 50 has obtained the safety parameter file 30, the 3D volume of protected space 10 for that aircraft 18 is generated. As previously described, the 3D volume of protected space 10 comprises a plurality of nested 3D volumes of protected space 12, 14, 16—each of which is generated based on respective parameter values stored in the safety parameter file 30 (box 54). In particular, method 50 generates, relative to the aircraft 18, the inner volume of protected space 12 encapsulating aircraft 18 (box 54*a*). Method 50 also generates an outer volume of protected space 16 to encapsulate the inner volume of protected space 12 (box 54*b*). Method 50 also generates the one or more nested intermediate 3D volumes of protected space 14. As seen in the figures, each of the intermediate 3D volumes of protected space 14 encapsulates the inner 3D volume of protected space 12, and are themselves encapsulated by the 3D outer volume of protected space 16 (box 54*c*).

So generated, method 50 biases one or more of the nested 3D volumes of protected space 12, 14, 16 in the direction of travel (box 56). This permits aspects of the present disclosure are able to concentrate the subsequent intersection analysis on the airspace most likely to be intersected by other 3D volumes of protected space. That is, an aircraft flying through airspace is more likely to encounter another aircraft in front, over top, or underneath of it rather than behind it.

During flight operations, method 50 dynamically increases or decreases one or more of the nested 3D volumes of protected space 12, 14, 16 based on a phase of flight of aircraft 18 (box 58). Thus, aspects of the disclosure ensure that each nested 3D volume of protected space 12, 14, 16 surrounding an aircraft 18 is optimally sized for the aircraft's 18 current speed and altitude.

As previously stated, aspects of the present disclosure generate warning messages to alert appropriate personnel responsive to detecting an intersection $I_C$, $I_O$, or $I_E$ between the 3D volumes of protected space 10 of different aircraft 18. FIG. 6B illustrates message generation performed in method 50 according to one aspect.

Particularly, responsive to detecting that the volume of protected space 10 surrounding a first aircraft contacts the volume of protected space 10 surrounding a second aircraft (i.e., intersection $I_C$) (box 60), method 50 generates a "caution message" to alert appropriate personnel that two or more aircraft are within close proximity to each other (box 62). Such caution messages comprise visual and/or audible alerts, but need not comprise verbal commands for the pilots to take evasive action.

Responsive to detecting that the volume of protected space 10 surrounding the first aircraft overlaps the volume of protected space 10 surrounding the second aircraft (i.e., intersection $I_O$) (box 64), method 50 generates a "warning message" (box 66). The warning messages indicate that the two aircraft 18 are in dangerous proximity to each other, and that the pilots and/or ground personnel should take appropriate measures to prevent the aircraft from getting any nearer to each other.

Responsive to detecting that the volume of protected space 10 surrounding the first aircraft 18 partially or wholly encapsulates the second aircraft (i.e., intersection $I_E$) (box 68), method 50 generates a "collision message" (box 70). The collision message indicates that a collision between the two aircraft 18 is imminent, and comprises visual and/or audible warnings. In some aspects, however, the generated collision messages also comprise verbal commands (e.g., "CLIMB! CLIMB!" "DESCEND! DESCEND!") that the pilots of the aircraft must obey in order to avoid an imminent collision.

Figure 7:
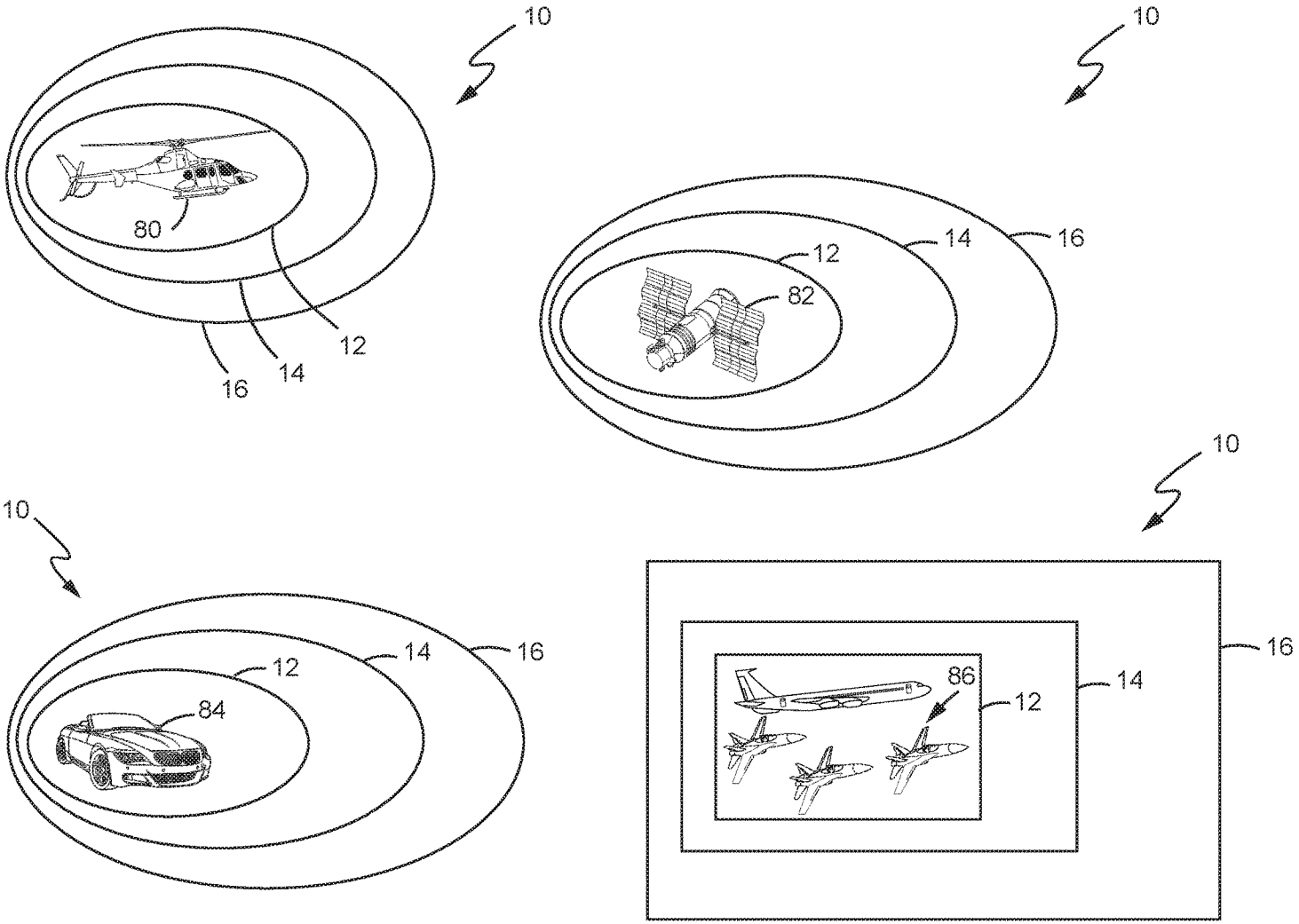
FIG. 7 illustrates some different types of vehicles, each encapsulated by a plurality of 3-dimensional nested volumes of protected space according to one aspect of the present disclosure.

It should be noted that the previous aspects describe the present disclosure in the context of fixed-wing aircraft 18. However, this is for illustrative purposes only. Those of ordinary skill in the art will readily appreciate that aspects of the present disclosure are also well-suited for encapsulating other types of vehicles with nested 3D volumes of protected space 10. FIG. 7 illustrates such vehicles as being rotorcraft 80, such as helicopters, spacecraft 84, such as satellites and both manned and unmanned spacecraft, and ground-based vehicles such as automobiles 84, which in one aspect, are autonomous. Additionally, under MARSA conditions, aircraft 18 may comprise a group of aircraft 86. Thus, in some aspects, multiple military aircraft are encapsulated within a single "block" of protected airspace and treated as a single aircraft.

Figure 8:
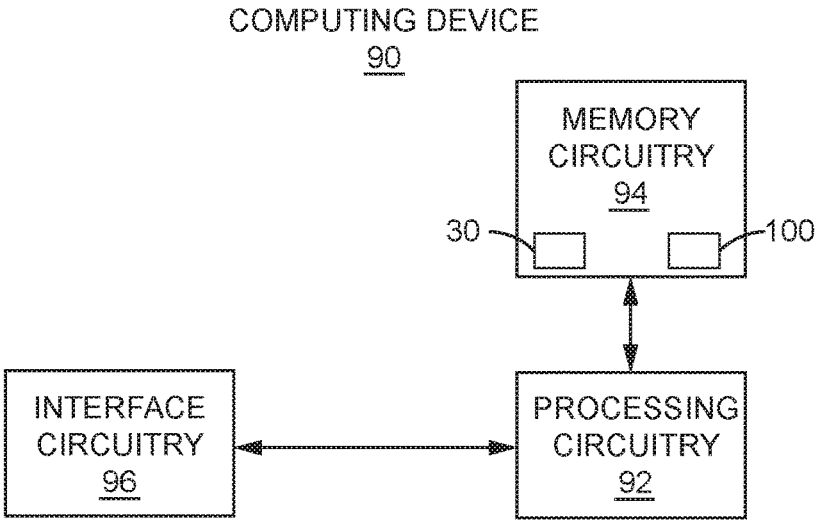
FIG. 8 is a block diagram illustrating a computing device configured according to one aspect of the present disclosure.

FIG. 8 is a block diagram illustrating a computing device 90 configured to implement aspects of the present disclosure. As previously described, computing device 90 can be implemented on aircraft 18 or on the ground and associated with the control tower 20.

The aspect of FIG. 8 illustrates computing device 90 as comprising processing circuitry 92 communicatively coupled via one or more buses to memory circuitry 94 and interface circuitry 96. According to various aspects of the present disclosure, processing circuitry 92 comprises one or more microprocessors, microcontrollers, hardware circuits, discrete logic circuits, hardware registers, digital signal processors (DSPs), field-programmable gate arrays (FPGAs), application-specific integrated circuits (ASICs), or a combination thereof. In one such aspect, the processing circuitry 92 includes programmable hardware capable of executing software instructions stored, e.g., as a machine-readable computer control program 100 in memory circuitry 94.

More particularly, processing circuitry 92 is configured to execute the control program 100 to generate the nested 3D volumes of protected space 10, detect intersections between the nested 3D volumes of protected space 10 of two or more different aircraft 18, and generate and send the appropriate alert notifications responsive to detecting such intersections, as previously described. In addition, processing circuitry 92 is also configured to implement these functions in accordance with the values stored in the safety parameter file(s) 30, as well as communicate those files 30 between the aircraft and the ground via a transponder frequency of the aircraft 18.

Memory circuitry 94 comprises any non-transitory machine-readable storage media known in the art or that may be developed, whether volatile or non-volatile, including (but not limited to) solid state media (e.g., SRAM, DRAM, DDRAM, ROM, PROM, EPROM, flash memory, solid state drive, etc.), removable storage devices (e.g., Secure Digital (SD) card, miniSD card, microSD card, memory stick, thumb-drive, USB flash drive, ROM cartridge, Universal Media Disc), fixed drive (e.g., magnetic hard disk drive), or the like, individually or in any combination. As seen in FIG. 8, memory circuitry 92 is configured to store one or more safety parameter files 30 as well as the control program 100.

Interface circuitry 96 comprises circuitry configured to control the input and output (I/O) data paths of the computing device 90. The I/O data paths include data paths for exchanging signals with other computers and mass storage devices over a communications network (not shown), and/or data paths for exchanging signals with a user. Such signals include the data required for the visual and audible messages that are generated responsive to detecting an intersection, signals from other aircraft and/or ground-based stations providing flight data and other information, as well as the contents of the safety parameter files 30 when retrieved from a remote storage location.

In some aspects of the present disclosure, interface circuitry 96 includes a transceiver configured to send and receive communication signals to and from an aircraft 18 over a transponder frequency.

Additionally, in some aspects of the present disclosure, interface circuitry 96 comprises input/output circuits and devices configured to allow a user to interface with computing device 90. Such circuitry and devices include, but is not limited to, display devices such as a Liquid Crystal Display (LCD) and/or a Light Emitting Diode (LED) display for presenting visual information to a user, one or more graphics adapters, display ports, video buses, a touchscreen, a graphical processing unit (GPU), and audio output devices such as speakers. In some aspects of the present disclosure, interface circuitry 96 includes circuitry and devices for accepting input from a user. Such circuitry and devices include a pointing device (e.g., a mouse, stylus, touchpad, trackball, pointing stick, joystick), a microphone (e.g., for speech input), an optical sensor (e.g., for optical recognition of gestures), and/or a keyboard (e.g., for text entry).

According to particular aspects of the present disclosure, interface circuitry 96 is implemented as a unitary physical component, or as a plurality of physical components that are contiguously or separately arranged, any of which may be communicatively coupled to any other, or communicate with any other component via processing circuitry 92.

Figure 9:
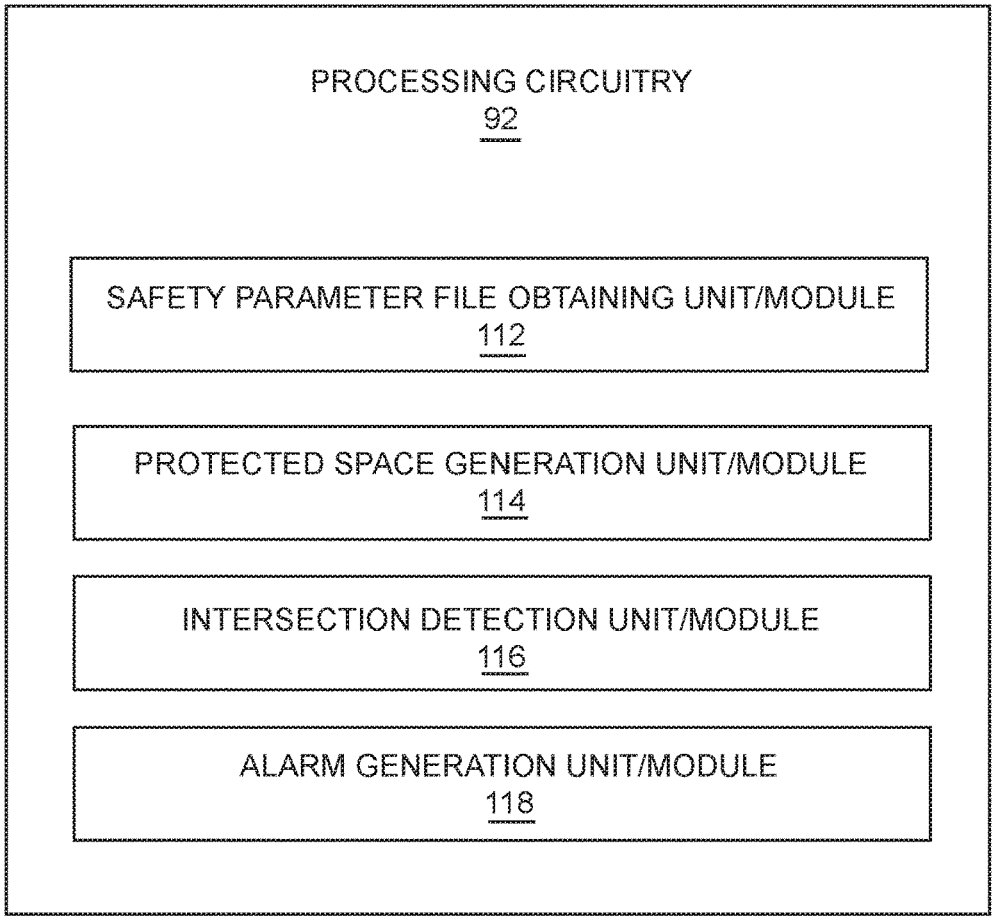
FIG. 9 is a block diagram illustrating processing circuitry configured according to one aspect of the present disclosure.

FIG. 9 is a block diagram illustrating processing circuitry 92 implemented according to different hardware units and software modules (e.g., as control program 100 store on memory circuitry 94) according to one aspect of the present disclosure. As seen in FIG. 9, processing circuitry 92 implements a safety parameter file obtaining unit and/or module 112, a protected space generation unit and/or module 114, an intersection detection unit and/or module 116, and an alarm generation unit and/or module 118.

The safety parameter file obtaining unit and/or module 112 is configured to obtain the safety parameter file 30 from a remote device via a network, an aircraft 18, or from a local non-transitory media, such as memory circuitry 94. The protected space generation unit and/or module 114 is configured to generate the nested 3D volumes of protected space 12, 14, 16 based on the parameter values in the obtained safety parameter file 30. The intersection detection unit and/or module 116 is configured to implement a CSG algorithm, such as a Boolean intersection, to detect whether any of the nested 3D volumes of protected space of multiple aircraft intersect each other. The alarm generation unit and/or module 118 is configured to generate an appropriate alarm notification to alert appropriate personnel to a particular detected intersection.

Aspects of the present disclosure further include various methods and processes, as described herein, implemented using various hardware configurations configured in ways that vary in certain details from the broad descriptions given above. For instance, one or more of the processing functionalities discussed above may be implemented using dedicated hardware, rather than a microprocessor configured with program instructions, depending on, e.g., the design and cost tradeoffs for the various approaches, and/or system-level requirements.

The foregoing description and the accompanying drawings represent non-limiting examples of the methods and apparatus taught herein. As such, the aspects of the present disclosure are not limited by the foregoing description and accompanying drawings. Instead, the aspects of the present disclosure are limited only by the following claims and their legal equivalents.

What is claimed is:

1. A method of managing air traffic, the method comprising:

for each aircraft of a plurality of aircraft, generating a corresponding 3-dimensional (3D) volume of protected space that surrounds and moves with the aircraft, wherein generating the 3D volume of protected space comprises generating two or more nested volumes of protected space that surround and move with the aircraft, and biasing the 3D volume of protected space in a direction of travel of the aircraft in real time;

dynamically increasing or decreasing a volume of one or more of the nested volumes of protected space based on a phase of flight of the aircraft;

detecting an intersection between the volume of protected space surrounding a first aircraft and the volume of protected space surrounding a second aircraft; generating an alarm notification responsive to detecting the intersection; and displaying the alarm notification on a display of one of the plurality of aircraft.

2. The method of claim 1 wherein generating the two or more nested volumes of protected space comprises computing each nested volume of protected space based on:

a current velocity of the aircraft;

a length of the aircraft; and corresponding horizontal, lateral, and vertical separation distance values defined for each nested volume of protected space.

3. The method of claim 1 wherein generating the two or more nested volumes of protected space that surround and move with the aircraft comprises:

generating, relative to the aircraft, an inner volume of protected space; and generating an outer volume of protected space encapsulating the inner volume of protected space.

4. The method of claim 3 wherein generating the two or more nested volumes of protected space that surround and move with the aircraft further comprises generating one or more intermediate nested volumes of protected space, each of which encapsulates the inner volume of protected space, and each of which is encapsulated by the outer volume of protected space.

5. The method of claim 1 wherein generating the alarm notification comprises:

generating a caution message responsive to detecting the intersection between an outer nested volume of protected space surrounding the first aircraft and any of the nested volumes of protected space surrounding the second aircraft;

generating a warning message responsive to detecting the intersection between an intermediate nested volume of protected space surrounding the first aircraft and any of the nested volumes of protected space surrounding the second aircraft; and generating a collision message responsive to detecting the intersection between an inner nested volume of protected space surrounding the first aircraft and any of the nested volumes of protected space surrounding the second aircraft.

6. The method of claim 1 wherein detecting the intersection between the volume of protected space surrounding the first aircraft and the volume of protected space surrounding the second aircraft comprises one or more of:

detecting that the volume of protected space surrounding the first aircraft contacts the volume of protected space surrounding the second aircraft;

detecting that the volume of protected space surrounding the first aircraft overlaps the volume of protected space surrounding the second aircraft; and detecting that the volume of protected space surrounding the first aircraft is encapsulated within the volume of protected space surrounding the second aircraft.

7. The method of claim 1 wherein the intersection between the volume of protected space surrounding the first aircraft and the volume of protected space surrounding the second aircraft is computed as a Boolean intersection.

8. A computing device comprising:

interface circuitry configured to send and receive data; and processing circuitry operatively coupled to the interface circuitry and configured to:

generate, for each aircraft of a plurality of aircraft, a corresponding 3-dimensional (3D) volume of protected space that surrounds and moves with the aircraft, wherein to generate the 3D volume of protected space, the processing circuitry is configured to generate two or more nested volumes of protected space that surround and move with the aircraft, and bias the 3D volume of protected space in a direction of travel of the aircraft in real time;

dynamically increase or decrease a volume of one or more of the nested volumes based on a phase of flight of the aircraft;

detect an intersection between the volume of protected space surrounding a first aircraft and the volume of protected space surrounding a second aircraft; generate an alarm notification responsive to detecting the intersection; and display the alarm notification on a display of one of the plurality of aircraft.

9. The computing device of claim 8 wherein the processing circuitry is further configured to:

obtain, for each of the plurality of aircraft, a corresponding safety parameter file comprising horizontal, lateral, and vertical separation distance values for each nested volume of protected space; and generate the two or more nested volumes of protected space based in part on the horizontal, lateral, and vertical separation distance values.

10. The computing device of claim 8 wherein to generate the two or more nested volumes of protected space that surround and move with the aircraft, the processing circuitry is configured to:

generate, relative to the aircraft, an inner volume of protected space; and generate an outer volume of protected space encapsulating the inner volume of protected space.

11. The computing device of claim 10 wherein to generate the two or more nested volumes of protected space that surround and move with the aircraft, the processing circuitry is further configured to generate one or more intermediate nested volumes of protected space, each of which encapsulates the inner volume of protected space, and each of which is encapsulated by the outer volume of protected space.

12. The computing device of claim 8 wherein the computing device comprises a collision avoidance system integrated with the first aircraft.

13. The computing device of claim 8 wherein the computing device comprises a ground-based collision avoidance system.

14. The computing device of claim 8 wherein the processing circuitry is configured to compute the intersection between the volume of protected space surrounding the first aircraft and the volume of protected space surrounding the second aircraft as a Boolean intersection.

15. A non-transitory computer readable medium storing a computer program product for controlling a programmable computing device, the computer program product comprising software instructions that, when executed on processing circuitry of the programmable computing device, cause the processing circuitry to:

generate, for each aircraft of a plurality of aircraft, a corresponding 3-dimensional (3D) volume of protected space that surrounds and moves with the aircraft, wherein to generate the 3D volume of protected space, the processing circuitry is configured to generate two or more nested volumes of protected space that surround and move with the aircraft, and bias the 3D volume of protected space in a direction of travel of the aircraft in real time;

dynamically increase or decrease a volume of one or more of the nested volumes based on a phase of flight of the aircraft;

detect an intersection between the volume of protected space surrounding a first aircraft and the volume of protected space surrounding a second aircraft; generate an alarm notification responsive to detecting the intersection; and display the alarm notification on a display of one of the plurality of aircraft.

16. The non-transitory computer readable medium of claim 15 wherein the software instructions, when executed on the processing circuitry of the programmable computing device, further cause the processing circuitry to generate the two or more nested volumes of protected space by computing each nested volume of protected space based on:

a current velocity of the aircraft;

a length of the aircraft; and corresponding horizontal, lateral, and vertical separation distance values defined for each nested volume of protected space.

17. The non-transitory computer readable medium of claim 15 wherein the software instructions, when executed on the processing circuitry of the programmable computing device, further cause the processing circuitry to generate the two or more nested volumes of protected space that surround and move with the aircraft by:

generating, relative to the aircraft, an inner volume of protected space; and generating an outer volume of protected space encapsulating the inner volume of protected space.

18. The non-transitory computer readable medium of claim 15 wherein the intersection between the volume of protected space surrounding the first aircraft and the volume of protected space surrounding the second aircraft is computed as a Boolean intersection.

19. The non-transitory computer readable medium of claim 15 wherein the computing device comprises a collision avoidance system integrated with the first aircraft.

20. The non-transitory computer readable medium of claim 15 wherein the computing device comprises a ground-based collision avoidance system.

* * * * *